United States Patent [19]

Aoki

[11] Patent Number: 4,866,564

[45] Date of Patent: Sep. 12, 1989

[54] ELECTROMAGNETIC DRIVE CIRCUIT

[75] Inventor: Hiroshi Aoki, Tokyo, Japan

[73] Assignee: Seikosha Co., Ltd., Japan

[21] Appl. No.: 164,429

[22] Filed: Mar. 4, 1988

[30] Foreign Application Priority Data

Mar. 6, 1987 [JP] Japan ..... 62-51263

[51] Int. Cl.[4] ..... H01H 47/12; G04C 3/02

[52] U.S. Cl. ..... 361/203; 368/166; 368/181; 361/159

[58] Field of Search ..... 368/165, 166, 181; 84/484; 361/159, 203, 147

[56] References Cited

U.S. PATENT DOCUMENTS 4,196,579 4/1980 Schaefer ..... 368/165

FOREIGN PATENT DOCUMENTS 3126237 1/1983 Fed. Rep. of Germany ..... 368/166

*Primary Examiner*—L. T. Hix
*Assistant Examiner*—David M. Gray
*Attorney, Agent, or Firm*—Bruce L. Adams; Van C. Wilks

[57] ABSTRACT

Herein disclosed is an electromagnetic drive circuit for driving a pendulum or the like, comprising: a coil for detecting and driving a permanent magnet; a reference voltage source having a variable reference voltage; a comparator for generating an output when the induced voltage of the coil exceeds the reference voltage; a pulse generator for generating a drive pulse in response to generation of the output of the comparator; a driver responsive to the drive pulse for feeding a drive current to the coil; and a controller responsive to the output of the comparator for controlling the reference voltage in accordance with the amplitude of the induced voltage. It is possible to integrate the most of construction and to eliminate the disadvantage of generating the drive pulses at the level of the induced voltage other than its maximal point so that the automatic control can be accomplished to effect the drive efficiently at the maximal point of the induced voltage at all times. Thus, the permanent magnet can be driven efficiently with the stable amplitude.

16 Claims, 5 Drawing Sheets

ELECTROMAGNETIC DRIVE CIRCUIT

BACKGROUND OF THE INVENTION

1. Field of the Invention

The present invention relates to an electromagnetic drive circuit to be used for driving a pendulum or the like.

2. Description of the Prior Art

An example of a drive circuit for detecting and driving the pendulum of a clock with a single coil is shown in FIG. 8. The operations where a dipole permanent magnet M, as shown in FIG. 9, is to be driven by that drive circuit will be described in the following. As the permanent magnet M moves in the direction of the arrow sequentially to the positions a to e of FIG. 9, voltages, as shown in FIG. 10, are induced in a coil $L_2$. Specifically, the induced voltage takes its maximum at the position c and has smaller amplitudes between the positions a and b and between d and e.

This induced voltage is generated at a terminal P of FIG. 8. When the induced voltage exceeds a reference voltage $v_r$ of FIG. 11A, a transistor $T_2$ of FIG. 8 is turned off whereas a transistor $T_1$ is turned on so that a drive current flows in the coil $L_2$. The ON time t of the transistor $T_1$ is determined by the time constant of a capacitor C and a resistor $R_1$.

In order to drive the magnet efficiently, it is preferable to drive it at the maximal point (as indicated at c in FIG. 10) of the induced voltage. In order to effect the drive at that timing, the reference voltage $v_r$ and a drive time are properly set.

In case the pendulum is driven, the amplitude of the induced voltage will fluctuate depending upon the swing angle of the pendulum. If the reference voltage $v_r$ is set at a level of FIG. 11A, for example, the induced voltage may exceed the reference voltage other than at its maximal point as the swing angle increases so that the amplitude of the induced voltage augments, as shown in FIG. 11B. This excess may invite a malfunction.

If the reference voltage is set at a high level so as to prevent the malfunction, the induced voltage may fail to exceed the reference voltage and drive the magnet in case the swing angle is small or in case the pendulum has a long period.

This makes it necessary to change the reference voltage each time in accordance with the swing angle and period of the pendulum.

A detailed description of the prior art circuit constitution is given above, but the biggest defect thereof is the incapability of integrating the circuit constitution.

SUMMARY OF THE INVENTION

It is a primary object of the present invention to provide an electromagnetic driving circuit in which a circuit constitution except a coil can be integrated.

It is, therefore, an object of the present invention to provide an electromagnetic drive circuit for detecting and driving a permanent magnet with a single coil, which circuit is enabled to automatically adjust the reference voltage to an optimum level.

According to the present invention, there is provided an electromagnetic drive circuit comprising: a coil for detecting and driving a permanent magnet; a reference voltage source having a variable reference voltage; a comparator for generating an output when the induced voltage of said coil exceeds said reference voltage; a pulse generator for generating a drive pulse in response to generation of the output of said comparator; a driver responsive to said drive pulse for feeding a drive current to said coil; and a controller responsive to the output of said comparator for controlling said reference voltage in accordance with the amplitude of said induced voltage.

In other words, the electromagnetic drive circuit according to the present invention is provided with a comparator for generating an output when the induced voltage of a coil for detecting and driving a permanent magnet exceeds a reference voltage. Also provided is a pulse generator for generating a drive pulse in response to generation of the output of the comparator. In response to this drive pulse, a drive current is fed to the coil so that the reference voltage may be controlled in response to the output of the comparator in accordance with the amplitude of the induced voltage.

BRIEF DESCRIPTION OF THE DRAWINGS

Other objects, features and advantages of the present invention will become apparent from the following description taken with reference to the accompanying drawings, in which.

DESCRIPTION OF THE PREFERRED EMBODIMENTS

Figure 1:
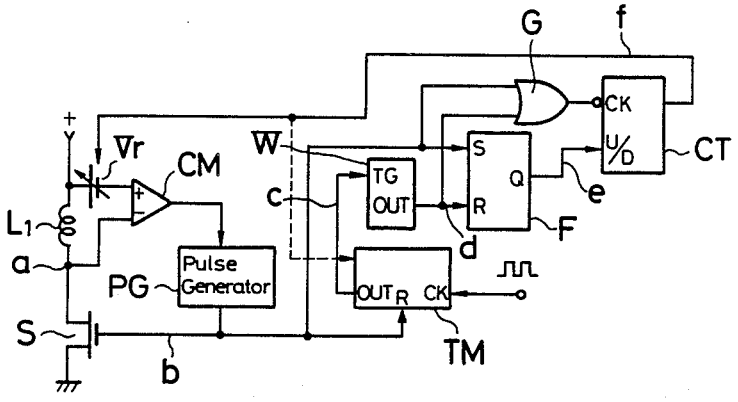
FIG. 1 is a logic circuit diagram showing one embodiment of the present invention.

In FIG. 1, reference letters $V_r$ designates a reference voltage source which has a variable reference voltage. Letters CM designate a comparator for generating an output when the induced voltage of a coil $L_1$ exceeds a reference voltage $v_r$. Letters PG designate a pulse generator for generating a drive pulse having optimum timing and width in response to generation of the output of the comparator CM, as will be described after in detail. Letter S designates a transistor constituting a driver. Letters TM designate a timer circuit which has its time set at a longer period than the period of the pendulum. Letter W designates a one-shot pulse generator, and letter F designates a flip-flop, both of which constitute a second controller together. Letter G designates a gate, and letters CT designate an up-down counter, both of which constitute a first controller together.

Figure 2:
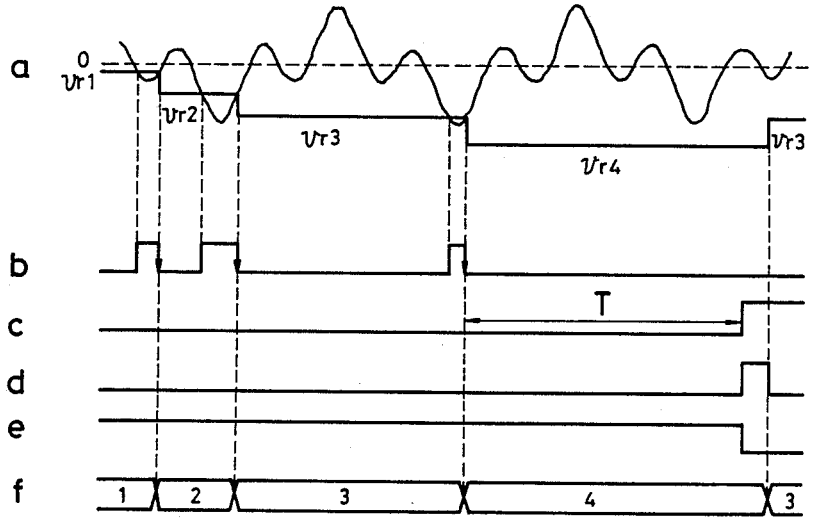
FIG. 2 is a voltage waveform chart for explaining the operations of the circuit shown in FIG. 1.

The operations will be described in the following with reference to FIG. 2. Let is be assumed that the reference voltage is set at a level $v_{r1}$ of FIG. 2a (at the lefthand end) by the output of the counter CT.

Here, if the induced voltage of the coil $L_1$ exceeds the reference voltage $v_{r1}$, as shown in FIG. 2a (at the lefthand end), drive pulses are generated from the pulse generator PG, as shown in FIG. 2b, so that the transistor S is turned on to feed the drive current to the coil $L_1$.

By the drive pulses, on the other hand, the flip-flop F is set so that its output brings the counter CT into an up mode. In response to the fall of the drive pulses, moreover, the counter CT is triggered to have its content shifted up by one, as shown in FIG. 2f, so that the reference voltage is raised to a level $v_{r2}$.

Incidentally, the drive pulses are fed to the reset input of the timer TM so that the timer TM is reset in case the drive pulses are generated.

Next, when the induced voltage exceeds the reference voltage $v_{r2}$, the drive pulses are likewise generated so that the content of the counter CT is further shifted up by one. As a result, the reference voltage is further raised to a level $v_{r3}$. This reference voltage is also further raised to a level $v_{r4}$ in case the drive pulses are generated.

If no induced voltage exceeds the reference voltage $v_{r4}$, the drive pulses are not generated any more so that the timer TM is not reset. As a result, an output is generated after lapse of time T, as shown in FIG. 2c, from the timer TM. Consequently, a pulse is generated, as shown in FIG. 2d, from the one-shot pulse generator W so that the flip-flop F is reset to bring the counter CT into a down mode. In response to the fall of the aforementioned pulse, moreover, the content of the counter CT is shifted down by one so that the reference voltage is dropped to the level $v_{r3}$.

After this, the reference voltage is stabilized to the level $v_{r3}$ or $v_{r4}$ to eliminate the disadvantage that the drive pulses are generated at an induced voltage other than the maximal point.

Incidentally, in the embodiment thus far described, the reference voltage is raised upon each generation of one of the drive pulses so as to simplify the explanations. As a matter of fact, however, the reference voltage may preferably be raised one step when the drive pulses are generated consecutively n (n=2, 3, - - -) or more times. In this case, a circuit for generating one pulse when n pulses are counted by the use of an n-counter (although not shown) for counting the number of the drive pulses generated is provided to feed its output to the gate G. The n-counter is reset by the pulses of the one-shot pulse generator W.

On the other hand, the timer time of the timer TM may be altered in accordance with the content of the counter CT. In case a pendulum having a short period is to be driven, more specifically, the amplitude of the induced voltage is generally enlarged so that the content of the counter CT is increased. In the case of the large content of the counter CT, therefore, the period of the pendulum is assumed to be short, and the timer time is changed over to a shorter one.

Figure 3:
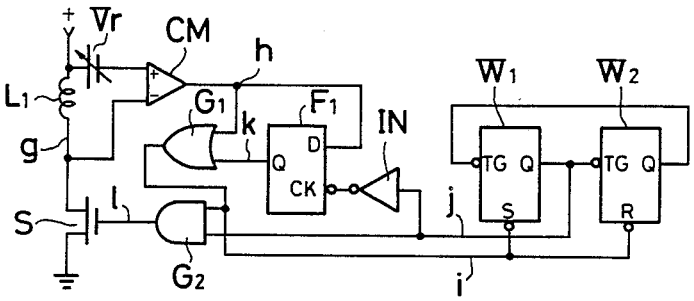
FIG. 3 is a logic,. circuit diagram showing a portion of the circuit of FIG. 1 in detail.

Next, a specific example of the pulse generator PG will be described in the following. In FIG. 3: reference letters $G_1$ and $G_2$ designate gates; letters $F_1$ designate a flip-flop; and letters IN designate an inverter. Letters $W_1$ and $W_2$ designate one-shot pulse generators which have their pulse widths set at $t_1$ and $t_2$, respectively. Incidentally, the same reference letters as those of FIG. 1 designate the same parts.

With the construction thus far described, the one-shot pulse generators $W_1$ and $W_2$ are set and reset, respectively, by the output of the gate $G_1$ while no output is being generated from the comparator CM.

If the induced voltage of the coil $L_1$ exceeds the reference voltage $v_r$, as shown in FIG. 4g, the gate $G_1$ generates an output, as shown in FIG. 4h, to release the one-shot pulse generators $W_1$ and $W_2$ from their set and reset states, respectively, through the gate $G_1$. As a result, the output of the one-shot pulse generator $W_1$ is inverted to "0" after lapse of the time $t_1$, as shown in FIG. 4j, so that the one-shot pulse generator $W_2$ is triggered to generate pulses having a width of the time $t_2$. Thus, the one-shot pulse generators $W_1$ and $W_2$ oscillate so that the drive pulse train of FIG. 4j is generated from the output of the one-shot pulse generator $W_1$. With the rise of the first pulse of the drive pulse train, the flip-flop $F_1$ is triggered to hold its output Q at "1", as shown in FIG. 4k. As a result, the output of the gate $G_1$ is held at "1", as shown in FIG. 4i, after generation of the output of the comparator CM, and the drive pulse train is generated from the gate $G_2$, as shown in FIG. 4l. With this drive pulse train, the transistor S is turned on to feed the drive current to the coil $L_1$.

The aforementioned drive pulse train is fed to the clock input of the flip-flop $F_1$, and its rise is used to judge the output state of the comparator CM. As a result, while the comparator CM is generating its output, the drive pulse train is generated to drive the coil $L_1$.

When the induced voltage drops below the reference voltage $v_r$ so that the output of the comparator CM is interrupted, the output of the flip-flop $F_1$ is inverted to interrupt the drive pulse train in response to the fall of the first drive pulse so that the drive of the coil $L_1$ is interrupted.

As has been described hereinabove, the drive current will flow in the coil while the induced voltage exceeds the reference voltage $v_r$.

In case the circuit thus far described is used as the pulse generator PG, the output of the gate $G_1$ is used as the input of the gate G, the reset input of the timer TM and the set input of the flip-flop F of FIG. 1.

Figure 4:
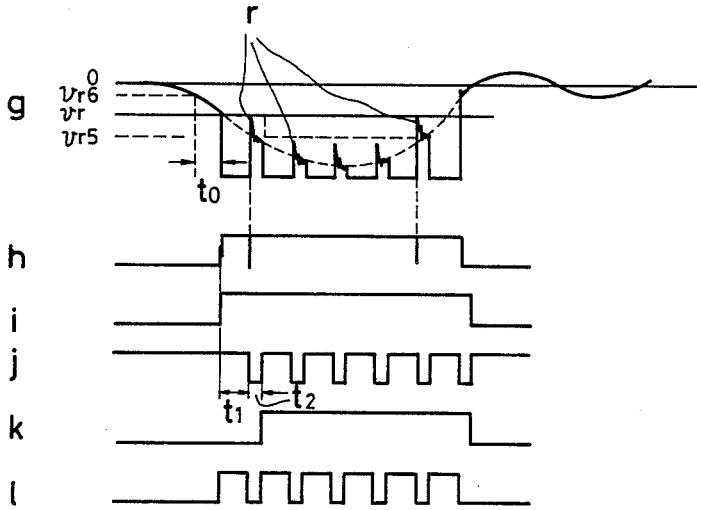
FIG. 4 is a voltage waveform chart for explaining the operations of the circuit shown in FIG. 3.

Although omitted from the foregoing description, the output width $t_2$ (FIG. 4) of the one-shot pulse generator $W_2$ is set, as follows. Since the coil $L_1$ is driven with the drive pulse train, a ringing r of normally 1 millisecond occurs, as shown in FIG. 4g, when the pulses are interrupted. Since, during generation of the ringing, the induced voltage of the coil $L_1$ is unstable, a malfunction may occur if a subsequent drive pulse is generated so that the flip-flop $F_1$ judges the output of the comparator CM. In order, therefore, that the subsequent drive pulse may be generated with the induced voltage being stable, the output width $t_2$ of the one-shot pulse generator $W_2$ is set at several milliseconds.

Incidentally, in case the coil is to be driven, energization of the permanent magnet is not adversely affected but can be ignored even in the presence of drive interruption of several milliseconds.

In the embodiment thus far described, the reference voltages for determining the drive starting and interrupting timings are set at the common value $v_r$. These two timings may be made different to adjust the drive ending timing. For example, the reference voltage is changed over to a level $v_{r5}$, as shown in FIG. 4g, with the output of the flip-flop $F_1$ so that the last drive pulse is not generated. This makes it possible to adjust the drive time more finely.

Generally speaking, the amplitude of the induced voltage is influenced by the fluctuations of the power supply voltage. If the amplitude of the induced voltage fluctuates, the timing at which the reference voltage is exceeded will be shifted to cause fluctuations of the drive timing and time period. In order to reduce the influences of the supply fluctuations, therefore, the reference voltage $v_r$ may be set at such a rather low level as to exert small influences in the presence of the voltage fluctuations so that the output from the comparator may be delayed a constant time period by a delay circuit (although not shown) to start the drive from the delayed instant. If the reference voltage is set at a low voltage $v_{r6}$, for example, as shown in FIG. 4*g*, the comparator generates, when the induced voltage exceeds the level $v_{r6}$, its output, which is delayed by a time $t_0$ by the delay circuit until it is fed to the flip-flop $F_1$ and the gate $G_1$. As a result, it is possible to reduce the influences from the fluctuations of the supply voltage and to drive the coil at the optimum timing and for the optimum drive time.

Figure 5:
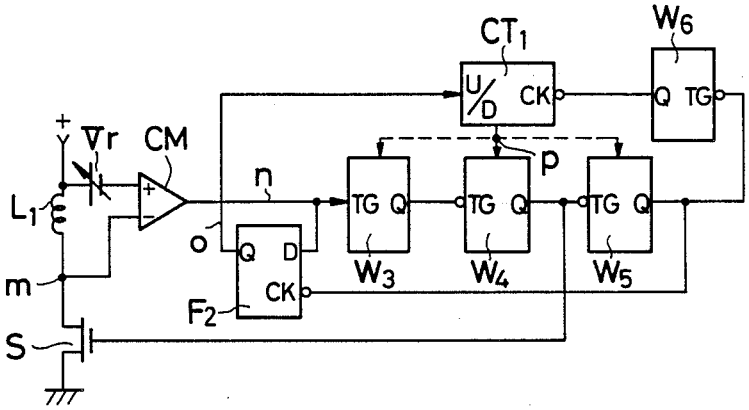
FIG. 5 is a logic circuit diagram showing another example of a circuit of the type shown in FIG. 3.

Next, another example of the pulse generator PG will be described in the following. In FIG. 5, letters $F_2$ designate a flip-flop, and letters $W_3$ to $W_6$ designate one-shot pulse generators. Of these, the one-shot pulse generator $W_4$ has a variable output pulse width, and the one-shot pulse generators $W_3$, $W_5$ and $W_6$ have their pulse widths set at $t_3$, $t_5$ and $t_6$, respectively. Letters $CT_1$ designate an up-down counter.

With the construction thus far described, it is assumed that the content of the counter $CT_1$ be designated at u so that the pulse width of the one-shot pulse generator $W_4$ is set at $t_4$.

Figure 6:
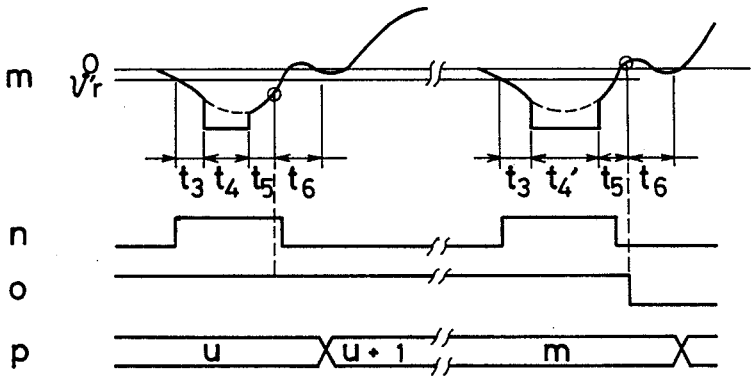
FIGS. 6 and 7 are voltage waveform charts for explaining the operations of the circuit shown in FIG. 5.

If the induced voltage exceeds the reference voltage $v_r$, the comparator CM generates the output, as shown in FIG. 6*n*, to trigger the one-shot pulse generator $W_3$ so that a pulse having the width $t_3$ is generated. In response to the fall of this pulse, the one-shot pulse generator $W_4$ generates drive pulse having the width $t_4$ to turn on the transistor S so that the drive current flows in the coil $L_1$. In response to the fall of this drive pulse, the one-shot pulse generator $W_5$ generates a pulse having the width $t_5$. In response to the fall of this pulse, the flip-flop $F_2$ and the one-shot pulse generator $W_6$ are triggered. The flip-flop $F_2$ has its D input fed with the output of the comparator CM, the state of which is read in the flip-flop $F_2$. In other words, it is judged whether or not the level of the induced voltage at the instant of the fall of the pulses from the one-shot pulse generator $W_5$ exceeds the reference voltage $v_r$. In case the induced voltage exceeds the reference voltage, the output of the flip-flop $F_2$ takes the level "1" so that the counter $CT_1$ is brought into an up mode. In other words, it is judged in this case that the drive pulses have a small width and are not efficiently generated around the maximal point of the induced voltage.

In response to the fall of the pulse from the one-shot pulse generator $W_5$, on the other hand, a pulse having the width $t_6$ is generated from the one-shot pulse generator $W_6$ and is used as the clock input of the counter $CT_1$. As a result, the content of the counter $CT_1$ is shifted up by one to (u+1), as shown in FIG. 6*p*. As a result, the pulse width of the one-shot pulse generator $W_4$ is set at a longer value than the previous one.

As a result, the drive pulse width is subsequently corrected to the longer value.

It is assumed that these operations be repeated to change the content of the counter to m and the drive pulse width to $t_4'$, as shown in FIG. 6*m*. If the level of the induced voltage at the instant of the fall of the pulse from the one-shot pulse generator $W_5$ becomes lower than the reference level, the output of the flip-flop $F_2$ is inverted to the level "0", as shown in FIG. 6*o*, so that the counter $CT_1$ is brought into a down mode. As a result, the content of the counter $CT_1$ is shifted down to (m−1) so that the width of the subsequent drive pulse is shortened one step.

As a result, the drive pulse width is alternately changed over to the value $t_4'$ and the shorter value so that it is stabilized.

Thus, the drive pulse width can be automatically stabilized at the optimum timing to the predetermined width to attain a stabilized constant swing angle.

Figure 7:
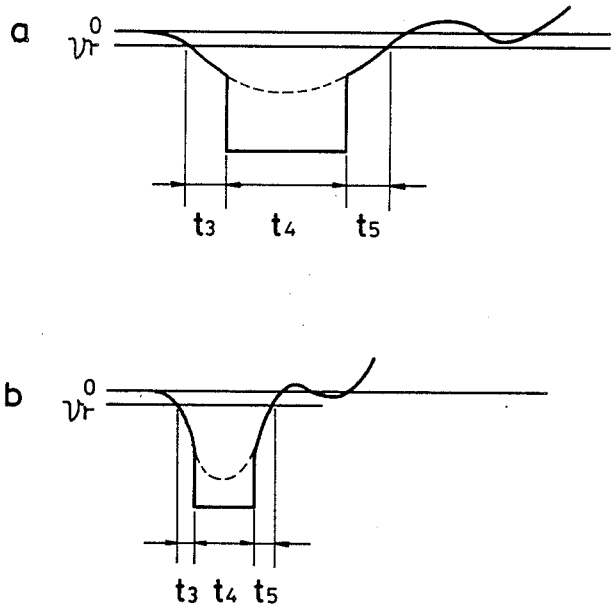
Figure 8:
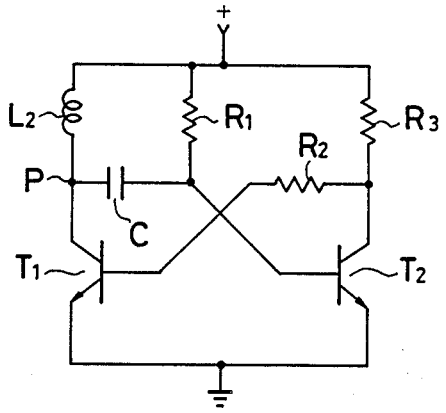
FIG. 8 PRIOR ART
FIG. 8 is an electric circuit diagram showing an example of the drive circuit of the prior art.
Figure 9:
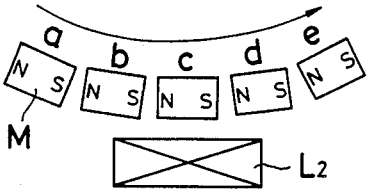
FIG. 9 is an explanatory diagram showing the relation between the coil and the permanent magnet.
Figure 10:
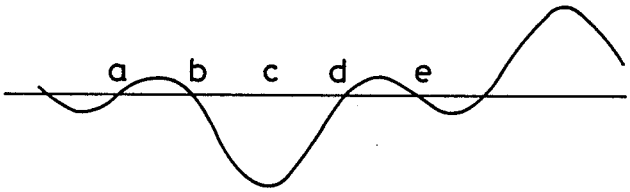
FIG. 10 is a voltage waveform chart illustrating the induced voltage generated by the coil of FIG. 9.
Figure 11:
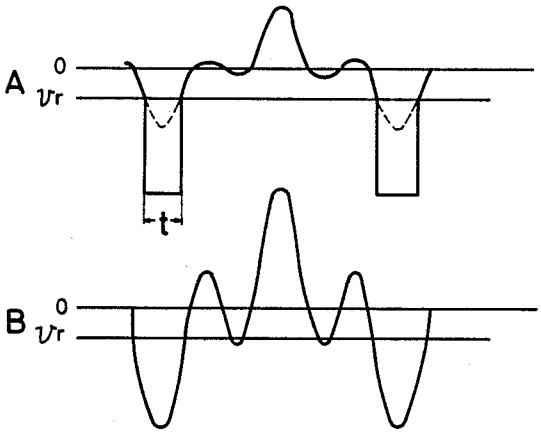
FIG. 11 PRIOR ART
FIG. 11 is a voltage waveform chart for explaining the defect of the circuit shown in FIG. 8.

Incidentally, in the example described above, only the drive pulse width is adjusted. The present invention should not be limited thereto, but programmable one-shot circuits may be used as the one-shot pulse generators $W_3$ and $W_5$ so that their pulse widths may be suitably adjusted in accordance with the content of the counter $CT_1$. In case the swing angle of the pendulum is to be set at a small value, for example, the time periods $t_3$ to $t_5$ have to be stabilized in slightly longer states, as shown in FIG. 7*a*, because the amplitude of the induced voltage is small, as shown in FIG. 7*a*, in the stable state and gently changes. In case the pendulum swing angle is to be set at a large value, the amplitude of the induced voltage becomes large and changes steeply in the stable state, as shown in FIG. 7*b*, and the width of the drive pulses may be short. Therefore, the time periods $t_3$ to $t_5$ have to be stabilized at smaller values than those of FIG. 7*a*.

The states of FIGS. 7*a* and 7*b* are different in the ratios of the time period $t_4$ to the time periods $t_3$ and $t_5$, and these ratios may be adjusted to set the stable swing angle. In case the stability is desired in the state of FIG. 7*b*, for example, the pulse widths of the one-shot pulse generators $W_3$ to $W_5$ are set to have the individual time periods at the shown ratios so that they may be changed while maintaining those ratios in accordance with the content of the counter $CT_1$.

Therefore, the swing angle is stabilized to a desired value by adjusting the time periods $t_3$ to $t_5$ automatically, as will be described in the following. Let is be assumed that the pulse widths of the one-shot pulse generators $W_3$ to $W_5$ be set at the values of FIG. 7*b* in accordance with the content of the counter $CT_1$ in the initial state. If the power source is supplied in this state, the pendulum starts its swing. Since the swing angle is small at first, the induced voltage generated is similar to that of FIG. 7*a*. As a result, at the instant of the fall of the pulse from the one-shot pulse generator $W_5$, the induced voltages exceeds the reference voltage. Then, the drive pulse width is judged to be short, and the content of the counter $CT_1$ is shifted up by one so that the time periods $t_3$ to $t_5$ are set at the longer values. These operations are repeated to augment the time periods $t_3$ to $t_5$ stepwise. Thus, the drive pulse width is gradually increased. In accordance with this, the swing angle of the pendulum is gradually increased with a slight delay, followed by the increase in the amplitude of the induced voltage.

As a result, at a certain instant, the drive pulse width becomes excessive so that the counter $CT_1$ is changed over to a down mode to reduce the time periods $t_3$ to $t_5$.

In accordance with this, the swing angle of the pendulum becomes smaller with a slight delay.

The operations thus far described are repeated to approach the state of FIG. 7*b*, in which the stability is attained at last. In other words, automatic adjustment is accomplished so that the drive may be effected efficiently with the optimum drive pulse width at the maximal point of the induced voltage.

Incidentally, the pulse width $t_5$ of the one-shot pulse generator $W_5$ is so set that the timing of the level judgement of the induced voltage may make it the easiest to judge the induced voltage. The aforementioned ringing is also taken into consideration for the setting.

In the embodiment thus far described, the reference voltage for determining the drive starting timing and the reference voltage for judging the induced voltage level after the end of the drive are set at the common level $v_r$. However, the latter reference voltage may be altered in accordance with the content of the counter $CT_1$. For example, the reference voltage is changed over to the voltage according to the content of the counter $CT_1$ while the one-shot pulse generators $W_4$ to $W_6$ are generating their output pulses. This change is equivalent to the adjustment of the pulse width of the one-shot pulse generator $W_5$.

Incidentally, without any consideration of the fluctuations or the like of the power source voltage, the one-shot pulse generator $W_3$ is not always indispensable, but the output of the comparator CM may be fed directly to the one-shot pulse generator $W_4$.

In the foregoing embodiment, moreover, the clock pulses are fed for each drive pulse to the counter $CT_1$. However, the content of the counter $CT_1$ may not be shifted up by one unless the up/down modes of the counter $CT_1$ are constant continuously for the three drive pulses. This similarly applies to the case of the down mode.

In this case, a ternary counter may be interposed between the one-shot pulse generator $W_6$ and the counter $CT_1$ such that it is reset each time the output level of the flip-flop $F_2$ is inverted. This construction can prevent any malfunction due to noises or the like.

According to the present invention, the permanent magnet is detected and driven with the single coil, and the output is generated from the comparator when the induced voltage of the coil exceeds the reference voltage so that the coil may be driven in response to the output of the comparator and so that the reference voltage may be controlled in accordance with the amplitude of the induced voltage. As a result, the construction exept the coil can be integrated. And it is possible to eliminate the disadvantage of generating the drive pulses at a level of the induced voltage other than its maximal point so that the automatic control can be accomplished to effect the drive efficiently at the maximal point of the induced voltage at all times. Thus, the permanent magnet can be driven efficiently with a stable amplitude.

What is claimed is:

1. An electromagnetic drive circuit comprising:

a coil for detecting and driving a permanent magnet;

a reference voltage source having a variable reference voltage;

a comparator for generating an output when the induced voltage of said coil exceeds said reference voltage;

a pulse generator for generating a drive pulse in response to generation of the output of said comparator;

a driver responsive to said drive pulse for feeding a drive current to said coil; and a controller responsive to the output of said pulse generator for controlling said reference voltage in accordance with the amplitude of said induced voltage.

2. An electromagnetic drive circuit according to claim 1, wherein said controller includes means for raising said reference voltage when said comparator generates its output continuously within a first predetermined time period; and means for dropping said reference voltage when said comparator generates no output for at least a second predetermined time period.

3. An electromagnetic drive circuit according to claim 2, wherein said controller raises said reference voltage when said comparator generates its output continuously n (n=1, 2, ---) times and drops said reference voltage when said comparator generates no output for at least said second predetermined time period.

4. An electromagnetic drive circuit according to claim 3, wherein said controller comprises a gate, an up-down counter, a one-shot pulse generator and a flip-flop whereby signals responsive to the output from said comparator are input to said counter to cause said counter to raise said reference voltage and signals responsive to the absence of output from said comparator are input to said counter to lower said reference voltage.

5. An electromagnetic drive circuit according to claim 1, wherein said driver comprises a transistor.

6. An electromagnetic circuit comprising:

a coil for detecting and driving a permanent magnet;

a reference voltage source for generating a reference voltage;

a comparator responsive to voltage induced in said coil by the magnet and to said reference voltage to generate an output signal when induced voltage of said coil exceeds said reference voltage;

means for generating a drive pulse for driving said coil in response to said output signal from said comparator; and means for adjusting the duration of said drive pulse in accordance with the amplitude to said induced voltage to ensure that said drive pulse occurs when the amplitude of said induced voltage is at a maximum.

7. The drive circuit of claim 6 in which said adjusting means comprises:

means for generating a first pulse of predetermined duration in response to said output signal, said drive pulse being generated upon expiration of said first pulse;

means responsive to expiration of said drive pulse for generating a second pulse of predetermined duration;

means for comparing said induced voltage to said reference voltage upon expiration of said second pulse;

means for generating a control signal if said induced voltage is different from said reference voltage; and means for changing the duration of said drive pulse in response to said control signal.

8. The drive circuit of claim 7 in which the duration of said drive pulse is increased if said induced voltage exceeds said reference voltage.

9. The drive circuit of claim 7 in which the duration of said drive pulse is decreased if said induced voltage is less than said reference voltage.

10. A method for correcting the motion of a pendulum, comprising the steps of:

inducing voltage in an electromagnetic coil representative of the motion of the pendulum;

comparing said induced voltage with a predetermined reference voltage and generating an output signal when said induced voltage exceeds said reference voltage;

generating a drive pulse for said coil of predetermined duration in response to said output signal; and changing said reference voltage upon expiration of said drive pulse in response to the presence or absence of said output signal.

11. The method of claim 10 comprising the step of raising said reference voltage in response to said output signal.

12. The method of claim 10 comprising the step of reducing said reference voltage in the absence of said output signal for a predetermined period of time.

13. A method for correcting the motion of a pendulum, comprising the steps of:

inducing voltage in an electromagnetic coil representative of the motion of the pendulum;

comparing said induced voltage with a predetermined reference voltage and generating an output signal when said induced voltage exceeds said reference voltage;

generating a drive pulse for driving said coil in response to said output signal, and adjusting the duration of said drive pulse in accordance with the rate of change of said induced voltage to ensure that said drive pulse occurs when the amplitude of said induced voltage is at a maximum.

14. The method of claim 13 comprising the steps of:

generating a first pulse of predetermined duration in response to said output signal;

generating said drive pulse upon expiration of said first pulse;

generating a second pulse of predetermined duration upon expiration of said drive pulse;

comparing said induced voltage to said reference voltage upon expiration of said second pulse;

generating a control signal if said induced voltage exceeds said reference voltage, and changing the duration of said drive pulse in response to said control signal.

15. The method of claim 14 comprising the step of increasing the duration of said drive pulse in response to said control signal.

16. The method of claim 14 comprising the step of decreasing the duration of said drive pulse in the absence of said control signal.

* * * * *